United States Patent [19]

Maxwell

[11] Patent Number: 4,688,804

[45] Date of Patent: Aug. 25, 1987

[54] UPSTANDING TARGET STRUCTURE FOR PLAYING A GAME

[75] Inventor: David H. S. Maxwell, East Lothjan, Scotland

[73] Assignee: Maxwell Shooting Enterprises Limited, Edinburgh, Scotland

[21] Appl. No.: 652,076

[22] Filed: Sep. 19, 1984

[30] Foreign Application Priority Data

Nov. 16, 1983 [GB] United Kingdom ..... 8330548
Sep. 3, 1984 [GB] United Kingdom ..... 8422224

[51] Int. Cl.[4] ..... F41J 9/16

[52] U.S. Cl. ..... 273/363; 273/407; 273/DIG. 24; 124/34

[58] Field of Search ..... 273/363, 407, DIG. 24, 273/340, 342, 410, 362, 363, 364, 365, 148 B, 369, 359, 366; 40/624, 603; 272/29; 52/86, 146; 124/32

[56] References Cited

U.S. PATENT DOCUMENTS 3,080,166 3/1963 Clark ..... 273/407
3,088,738 5/1963 Meyer ..... 273/407
3,568,199 3/1971 Hartness ..... 124/32
3,589,727 6/1971 Lowry ..... 273/362
3,680,863 8/1972 Wallace et al. ..... 273/362

FOREIGN PATENT DOCUMENTS 687941 6/1964 Canada ..... 273/363

*Primary Examiner*—Richard C. Pinkham
*Assistant Examiner*—Gary Jackson
*Attorney, Agent, or Firm*—Saidman, Sterne, Kessler & Goldstein

[57] ABSTRACT

The apparatus comprises an upstanding target structure defining one or more scoring zones and a launcher for launching clay pigeons across the scoring zone or zones. Clay pigeons are launched from a trench and a shooter occupying a cabin scores by hitting a clay pigeon while it is within one of the scoring zones, as viewed, for instance, from a location adjacent to the shooter. The game lends itself to television coverage and a method of televising or recording the game is also disclosed.

15 Claims, 3 Drawing Figures

UPSTANDING TARGET STRUCTURE FOR PLAYING A GAME

BACKGROUND OF THE INVENTION

This invention relates to apparatus for playing a game, to a target structure for use in the game, and to a method of televising or recording the game.

SUMMARY OF THE INVENTION

In a first aspect the invention provides apparatus for playing a game, comprising an upstanding target structure defining one or more scoring zones, a launcher for launching clay pigeons or other appropriate frangible projectiles across the scoring zone or zones defined by said target structure, and a plurality of clay pigeons or other frangible projectiles.

The game may be played by launching clay pigeons or other projectiles across the scoring zone or zones defined by the target structure from a location intermediate a shooter (competitor playing the game) and the target structure. A shooter scores by hitting a clay pigeon or other projectiles whilst it is within one of the scoring zones, as viewed, for instance, from a location adjacent to the shooter.

Preferred and/or optional features of the first aspect of the invention are set forth in claims 2–15.

In a second aspect the invention provides a target structure for use in a shooting game, comprising at least two parallel or substantially parallel arcuate members defining one or more scoring zones, the arcuate members being formed of a plurality of sections releasably connected together so that the target structure can be dismantled, and means for supporting the arcuate members upright on the ground.

BRIEF DESCRIPTION OF THE DRAWINGS

The invention will now be more particularly described, by way of example, with reference to the accompanying drawings, in which.

DESCRIPTION OF THE PREFERRED EMBODIMENT

Figure 1:
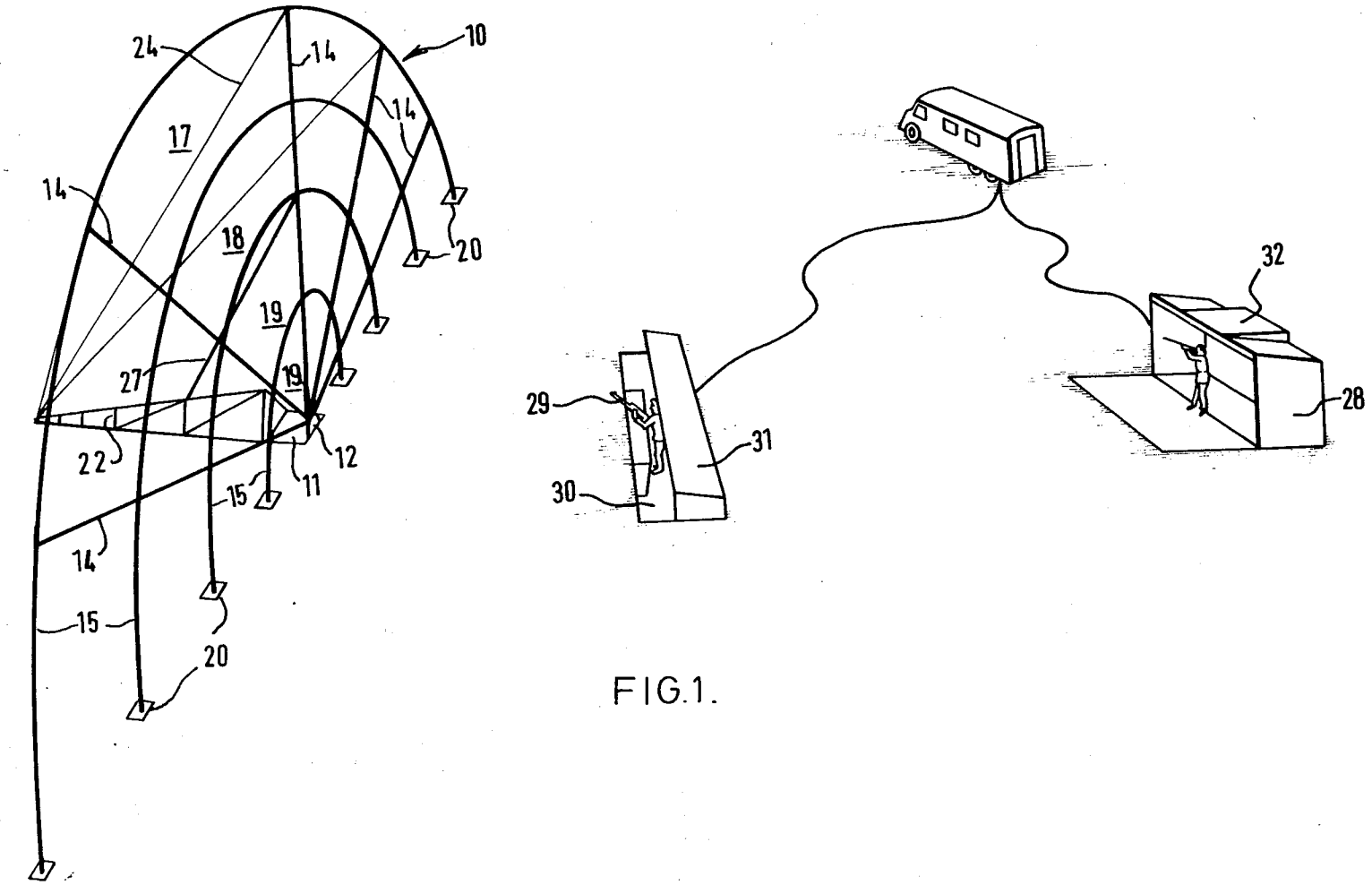
FIG. 1 is a schematic perspective view of one embodiment of apparatus according to the first aspect of the invention.
Figure 2:
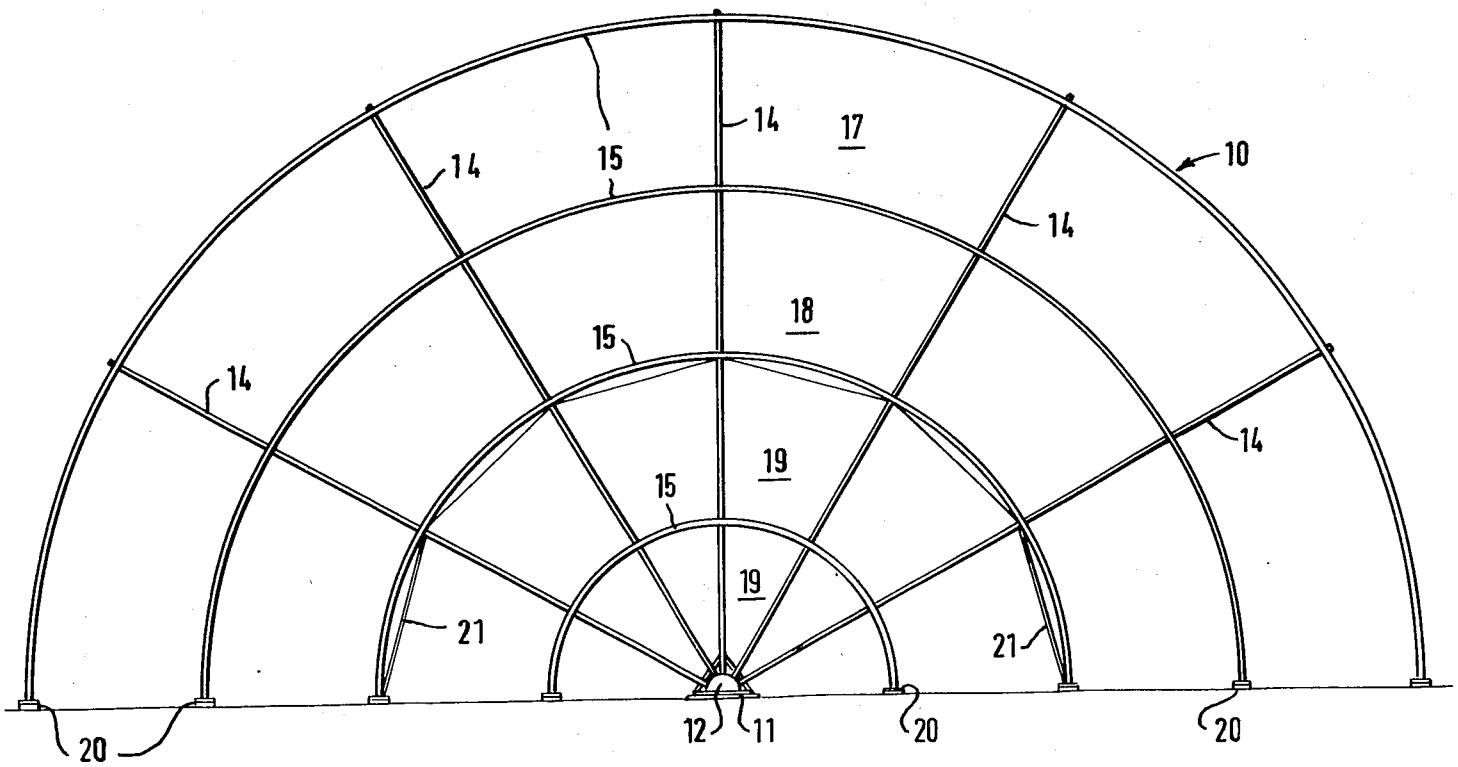
FIG. 2 is a front view of the target structure shown in FIG. 1, in more detail.

Referring to the drawings, the apparatus shown therein includes framework or a target structure 10, disposed at a target location of the shooting range, comprising a centre plate-like support 11 pinned to the ground, a D-shaped plate 12 pivotably connected to the front edge of the support 11 by a hinge 13, five radially extending trusses 14 equi-angularly spaced apart and secured to the D-shaped plate 12 by bolts or other appropriate fastening members, and four parallel spaced apart arcuate members 15 connected to the radially extending trusses 14. The arcuate members 15 are each made up of a plurality of sections each releasably connected at opposite ends to respective connectors 16 secured to the radially extending trusses 14. The arcuate members 15 are preferably tubular. The three outer arcuate members 15 may be coated with fluorescent material, such as fluorescent paint or tape, whilst the inner arcuate member and the trusses are painted black, so as to define three scoring zones 17, 18 and 19. However, the front member of the central, vertical truss 14 could also be coated with fluorescent material to divide each scoring zone into two equal segments.

The ends of the arcuate members 15 are pivotably connected to individual foot plates 20 pinned to the ground and cross ties 21 are provided between adjacent pairs of trusses 14 and between the end trusses and adjacent foot plates 20 to give the target structure added stability.

The target structure is assembled flat on the ground. A lifting arm 22 is pivotably connected to the rear edge of the support 11 by a hinge 23 and flexible stays 24 connect the free end of the arm 22 to the free outer ends of the trusses 14. In order to raise the target structure when assembled from the ground the lifting arm 22 is pivoted rearwardly from an upright position until its free end comes into contact with the ground. An anchoring plate 25 is secured to the free end of the lifting arm and this anchoring plate 25 is secured to bolts provided in either a concrete slab 26 cast in the ground or in a portable structure of suitable weight, when the target structure has been raised. Rigid stays 27 are then connected between the trusses 14 and the lifting arm 22 to hold the target structure in an upright position.

Figure 3:
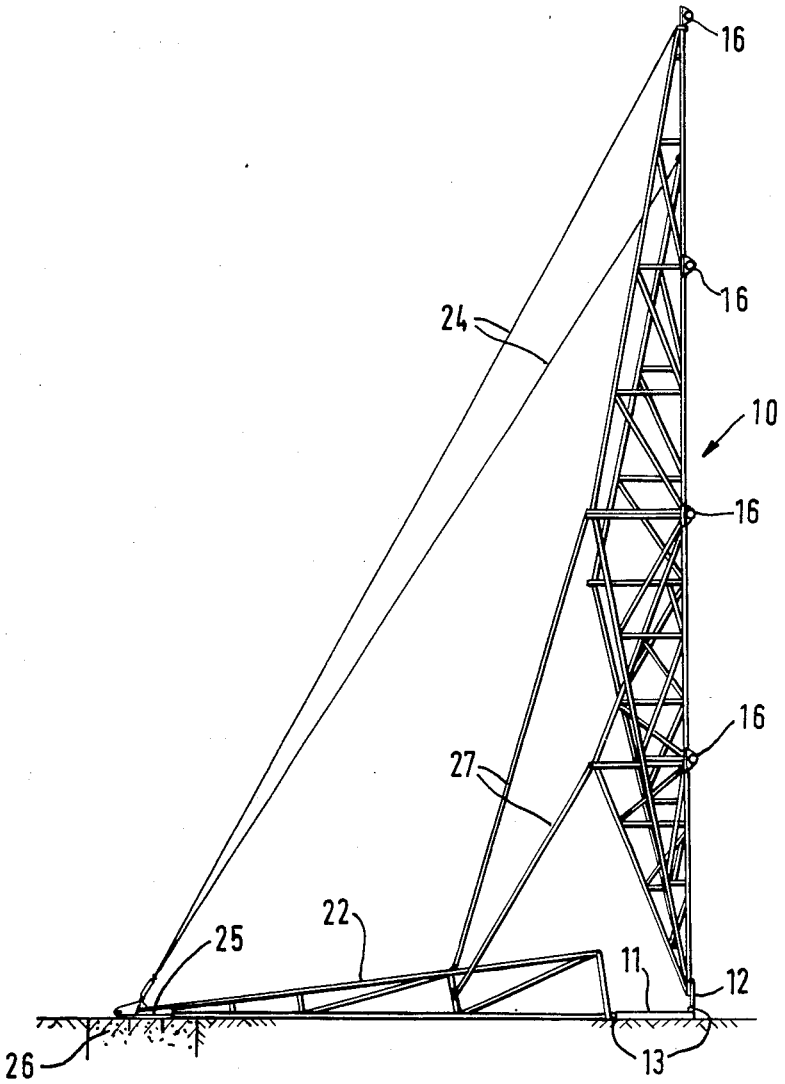
FIG. 3 is a side view of the target structure shown in FIG. 2.

When in an upright position, only the front members of the trusses 14 can be seen from a position directly in front of the target structure as shown in FIG. 3.

The stays 24 and 27 are painted black and at night only those parts of the target structure coated in fluorescent material will be discernable.

Typically, the radius of the outer arcuate member 15 is 40 feet, with a radial spacing of 10 feet between adjacent members 15. Alternatively, the radial spacing between adjacent members may decrease as considered from the D-shaped plate 12 to the outer member 15.

A shooter (competitor) playing the game occupies a cabin 28, which is disposed at a shooting location of the shooting range. The cabin 28 is spaced from the target structure 10 in a direction normal to the plane of the target structure 10 and a clay pigeon launcher 29 which may be of conventional type is located on a support surface disposed in a trench 30 arranged between the cabin 28 and the target structure 10. Typically, the distance between the cabin 28, which is located at one end of the shooting range, and the target structure 10, which is located at the opposite end of the shooting range, is 75 feet or less and the distance between the trench 30 and the target structure 10 is 30 feet or less.

The clay pigeon launcher 29 may have a motor which causes it to swing to and fro through 160° in a predetermined plane inclined to the horizontal and towards the target structure. The launcher is loaded by an operator in the trench 30. A shot-proof hood 31 is provided over the trench to protect the operator and a lamp is fitted to the rear of the hood 31 or to the cabin 28 to signal to the shooter when he may or may not trigger the launcher. The launcher is triggered automatically by a signal from the shooter, e.g. by an accoustic signal picked up by a transducer located in the cabin 28 and transmitted to the launcher 29.

The clay pigeons or other projectiles used in this game form the target for the shooter. They each have two major faces of which at least one may be fluorescent. Moreover, the clay pigeons may contain a powdery material which scatters when the shooter has a hit and which may be applied to the dashed face of the clay pigeon in the form of an emulsion. When played at night clay pigeons containing white powder may be used whereas when played in daylight clay pigeons containing black powder may be used. However, instead of containing powder the clay pigeons may be appropriately coloured.

The game lends itself to television coverage. The cabin 28 is of transparent shot-proof material and has a television camera mount 32 on its roof or in another appropriate position close to the cabin 28. Other television cameras may be located, for instance, in the trench 30, one directed at the launcher and one at the shooter through a transparent shot-proof panel in the rear of the hood 31.

The distance between the cabin 28 and target structure 10, typically 75 feet, is chosen to accommodate the angle of view of a standard television camera lens so that the entire target structure 10 can be displayed.

For safety reasons, there may be a cartridge dispenser in the cabin 28 so that competitors can be prevented from carrying ammunition. Also a light may be provided in the cabin 28 to signal when cartridges may be dispensed to a shooter and when the shooter may prepare to fire.

The game may be played by any number of competitors, each competitor scoring by hitting a clay pigeon whilst the clay pigeon is within one of the scoring zones as viewed, for instance, through the camera located on mounting 32.

By virtue of the inclined plane in which the clay pigeons are launched a large surface area is shown to the shooter and television camera on the mounting 32. Particularly at night, under flood-lighting, these clay pigeons will break, upon impact when hit by a shooter, with a dramatic explosion. This impact and subsequent breaking of the clay pigeons registers very clearly on a television screen. The scoring zones indicate the approximate location of the clay pigeons upon impact when hit by the shooter. The scoring zones are graded in degrees of difficulty, so that the quicker the hit, the more points are scored. Because the launcher swings to and fro through 160° the shooter will not be able to anticipate the direction in which the clay pigeon will leave the launcher, travel across the scoring zones defined by the target structure, and eventually outside the scoring zones. However, as an alternative to driving the launcher with a motor the angle of launch could be set by the operator in the trench.

The target structure 10 can be readily dismantled so that it can be moved from one site to another. To achieve this, the target structure is lowered to the ground, where the trusses 14 can be released from the D-shaped plate 12 and the arcuate members 15 broken down into their respective sections.

Whilst a preferred embodiment of the appratus has been described above, persons skilled in the art will realise that many modifications could be made to the apparatus without departing from the scope of the invention defined in the claims appended hereto. For instance, it is possible that other frangible projectiles may be used instead of the clay pigeons, with an appropriate launcher therefor.

I claim:

1. Apparatus for playing a game, comprising a shooting range having a shooting location at one end and a target location at an opposing end, a target comprising at least one projectile, means for indicating the approximate location of the target upon impact, said means comprising an upstanding framework disposed at said target location, said framework defining one or more scoring zones in said target location, and means for launching said target generally away from said shooting location towards said target location so as to traverse said scoring zones.

2. The apparatus of claim 1, wherein said framework defines at least two scoring zones.

3. The apparatus of claim 1, wherein said framework comprises at least two parallel or substantially parallel arcuate members, and means for supporting the arcuate members in a vertical or substantially vertical plane.

4. The apparatus of claim 3, wherein at least one of the arcuate members is provided with a fluorescent coating.

5. The apparatus of claim 3, wherein the arcuate members are each formed of a plurality of sections releasably connected together.

6. The apparatus of claim 1, wherein said launching means comprises a launcher having means for swinging said launcher to and fro in a predetermined plane inclined to the horizontal.

7. The apparatus of claim 1, wherein said launching means comprises a launcher having means for triggering said launcher remotely by a shooter.

8. The apparatus of claim 1, wherein each said projectile is frangible and contains a powdery material.

9. The apparatus of claim 1 wherein each said projectile is frangible and has at least one major surface which is flourescent.

10. Apparatus for playing a game, comprising an upstanding target structure defining one or more scoring zones, a launcher for launching clay pigeons or other appropriate frangible projectiles across the scoring zone or zones defined by said target structure, and a plurality of clay pigeons or other frangible projectiles, the target structure having at least two parallel or substantially parallel arcuate members, and means for supporting the arcuate members in a vertical or substantially vertical plane, wherein the arcuate members supporting means comprises a ground engageable support and a plurality of radial members connected to and extending radially from the support.

11. The apparatus of claim 10, wherein the radial members are trusses.

12. The apparatus of claim 10, wherein the radial members are pivotably connected to the support for movement between a first position in which they lie substantially horizontally on the ground and a second position in which they lie in a vertical or substantially vertical plane.

13. The apparatus of claim 12, further comprising means for moving the radial members from said first to said second position to erect the target structure.

14. The apparatus of claim 13, wherein the raising means comprises an arm pivotably connected to said central support and extending therefrom perpendicular to the plane containing the radial members, and a plurality of stays connected between the target structure and the arm.

15. The apparatus of claim 14, wherein the arm has an anchor plate, securable to the ground, at its end remote from the central support.

* * * * *